US007128401B2

(12) United States Patent
Dodd

(10) Patent No.: US 7,128,401 B2
(45) Date of Patent: Oct. 31, 2006

(54) THERMAL SENSE RESISTOR FOR A REPLACEABLE PRINTER COMPONENT

(75) Inventor: Simon Dodd, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 11/196,088

(22) Filed: Aug. 2, 2005

(65) Prior Publication Data

US 2005/0264595 A1 Dec. 1, 2005

(51) Int. Cl.
*B41J 2/05* (2006.01)

(52) U.S. Cl. ..... 347/62; 347/56; 347/59

(58) Field of Classification Search ..... None
See application file for complete search history.

(56) References Cited

U.S. PATENT DOCUMENTS

| | | | | |
|---|---|---|---|---|
| 4,973,993 | A | 11/1990 | Allen | |
| 5,072,235 | A | 12/1991 | Slowik | |
| 5,483,827 | A | 1/1996 | Kulka et al. | |
| 5,491,540 | A | 2/1996 | Hirst | |
| 5,574,484 | A | 11/1996 | Cowger | |
| 5,583,545 | A | 12/1996 | Pawlowski, Jr. | |
| 5,635,968 | A | 6/1997 | Bhaskar et al. | |
| 5,682,140 | A | 10/1997 | Christensen et al. | |
| 5,699,091 | A | 12/1997 | Bullock et al. | |
| 5,788,388 | A | 8/1998 | Cowger et al. | |
| 5,812,156 | A | 9/1998 | Bullock | |
| 5,835,817 | A | 11/1998 | Bullock et al. | |
| 5,881,451 | A | 3/1999 | Kneezel et al. | |
| 5,930,553 | A | 7/1999 | Hirst et al. | |
| 6,022,094 | A * | 2/2000 | Gibson et al. | 347/19 |
| 6,039,430 | A | 3/2000 | Helterline et al. | |
| 6,081,280 | A * | 6/2000 | Bolash et al. | 347/9 |
| 6,102,508 | A | 8/2000 | Cowger | |
| 6,113,208 | A | 9/2000 | Benjamin et al. | |
| 6,126,265 | A | 10/2000 | Childers | |
| 6,151,039 | A | 11/2000 | Hmelar et al. | |
| 6,196,651 | B1 | 3/2001 | Zuber et al. | |
| 6,398,333 | B1 | 6/2002 | Mulay et al. | |
| 6,672,699 | B1 | 1/2004 | Jeong | |
| 6,996,622 | B1 | 2/2006 | Itoh | |

FOREIGN PATENT DOCUMENTS

| | | |
|---|---|---|
| HU | 176711 | 9/1980 |
| JP | 59177620 | 10/1984 |
| JP | 01156079 | 6/1989 |
| JP | 02281969 | 11/1990 |
| JP | 10214702 | 8/1998 |
| JP | 63192058 | 8/1998 |
| JP | 2000006459 | 1/2000 |

OTHER PUBLICATIONS

M. Ganim, vol. 23, No. 9, Feb. 1981 IBM Techical Disclosure Bulletin entitled "XP-02219413 Print Hammer Flight Time Temperature —Compensation Circuit"; pp. 4109-4109.

* cited by examiner

*Primary Examiner*—Thinh Nguyen

(57) ABSTRACT

A replaceable printer component (14) includes a thermal sense resistor (14B) having a first resistance. A resistance modifier (510) coupled to the thermal sense resistor modifies the first resistance.

12 Claims, 6 Drawing Sheets

200

202A 202B

204

| Thermal Sense Resistance(Ohms) | Bit Values |
|---|---|
| not blown | 0000000 |
| 178 | 0000001 |
| 179 | 0000010 |
| 180 | 0000011 |
| 181 | 0000100 |
| 182 | 0000101 |
| 183 | 0000110 |
| 184 | 0000111 |
| 185 | 0001000 |
| Etc... | Etc... |

Fig. 2

THERMAL SENSE RESISTOR FOR A REPLACEABLE PRINTER COMPONENT

THE FIELD OF THE INVENTION

The present invention relates to printers. More particularly, the invention relates to a variable thermal sense resistor for a replaceable printer component.

BACKGROUND OF THE INVENTION

The art of inkjet technology is relatively well developed. Commercial products such as computer printers, graphics plotters, and facsimile machines have been implemented with inkjet technology for producing printed media. Generally, an inkjet image is formed pursuant to precise placement on a print medium of ink drops emitted by an ink drop generating device known as an inkjet printhead assembly. An inkjet printhead assembly includes at least one printhead. Typically, an inkjet printhead assembly is supported on a movable carriage that traverses over the surface of the print medium and is controlled to eject drops of ink at appropriate times pursuant to command of a microcomputer or other controller, wherein the timing of the application of the ink drops is intended to correspond to a pattern of pixels of the image being printed.

Inkjet printers have at least one ink supply. An ink supply includes an ink container having an ink reservoir. The ink supply can be housed together with the inkjet printhead assembly in an inkjet cartridge or pen, or can be housed separately. When the ink supply is housed separately from the inkjet printhead assembly, users can replace the ink supply without replacing the inkjet printhead assembly. The inkjet printhead assembly is then replaced at or near the end of the printhead life, and not when the ink supply is replaced.

Some replaceable printer components, such as some inkjet printhead assemblies, include a thermal sense resistor (TSR). A purpose of the TSR is to allow a printer to determine the temperature of the printhead assembly. Knowledge of the consistency of the TSR material allows a thermal coefficient of resistance (TCR) to be determined. The printer can determine the temperature of the printhead assembly based on the TCR and a measured resistance of the TSR.

Generally, the printhead assembly heats up in operation. A printer can monitor the TSR and change the printing algorithm to either add or subtract energy, thereby changing the size of the ink drops coming out. In the case of a cold die (e.g., a new cartridge has just been placed in the printer), the printer will recognize that the printhead assembly is cold and will provide extra energy so that the ink drops become a little bigger. As the die heats up, the printer will provide less and less energy. In some systems, the temperature of the printhead assemblies is monitored to prevent overheating. If the temperature reaches a certain threshold, the printer may go into a wait mode, where the printer pauses briefly to allow the printhead assembly to cool down.

In existing printer systems, analog hardware is used to measure the resistance of the TSR at a known temperature to use as a starting point for later temperature determinations. The initial resistance measurement is an analog measurement, which is not very precise. In addition, the analog measurement hardware is an expensive part of the printer.

SUMMARY OF THE INVENTION

One form of the present invention provides a replaceable printer component including a thermal sense resistor having a first resistance. A resistance modifier coupled to the thermal sense resistor modifies the first resistance.

BRIEF DESCRIPTION OF THE DRAWINGS

FIG. 2 is a diagram of a lookup table illustrating bit values associated with TSR resistance values according to one embodiment.

DETAILED DESCRIPTION

In the following detailed description of the embodiments, reference is made to the accompanying drawings that form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

I. Inkjet Printer

Figure 1:
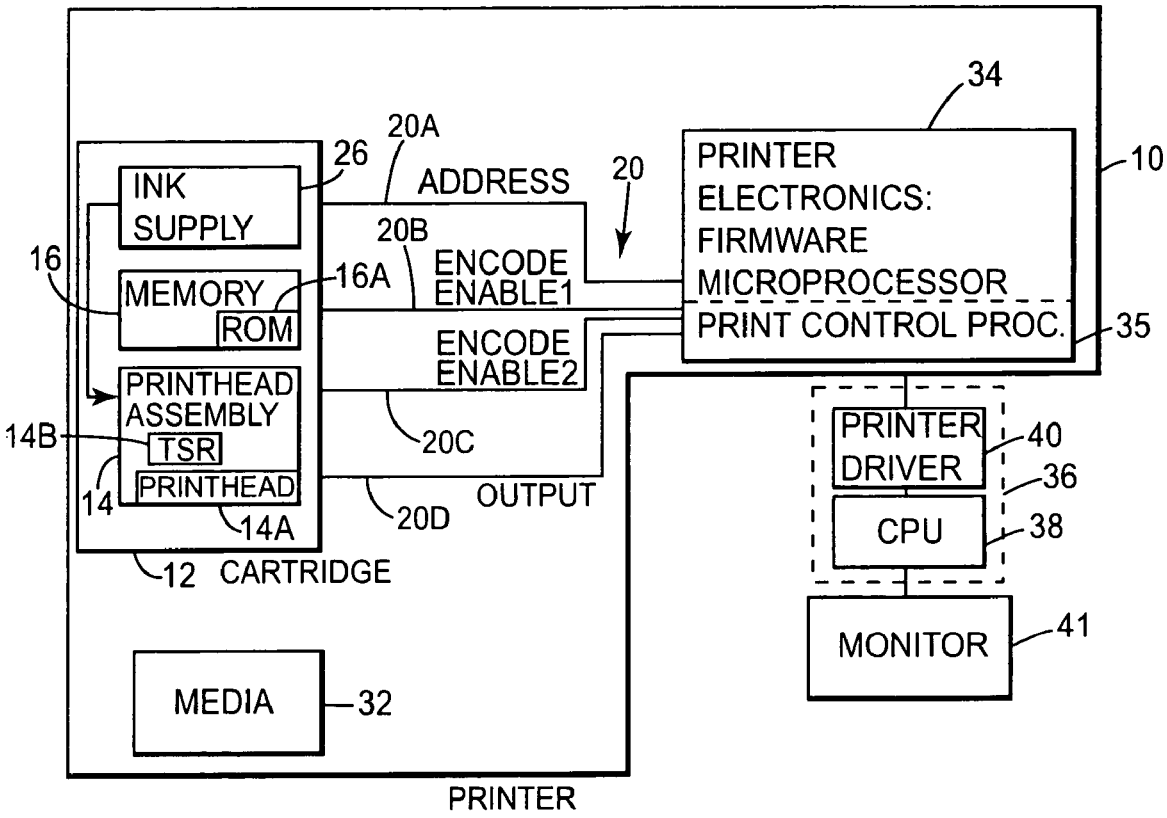
FIG. 1 is an electrical block diagram of major components of an inkjet printer according to one embodiment of the present invention.

FIG. 1 is an electrical block diagram of major components of an inkjet printer according to one embodiment of the present invention. Inkjet printer 10 includes removable inkjet cartridge 12, which includes inkjet printhead assembly 14, memory 16, and ink supply 26. Inkjet cartridge 12 is pluggably removable from printer 10. Inkjet printhead assembly 14 includes at least one printhead 14A, and thermal sense resistor (TSR) 14B. Memory 16 may include multiple forms of memory, including RAM, ROM and EEPROM, and stores data associated with inkjet printhead assembly 14 and ink supply 26. In one embodiment, memory 16 includes factory-written data and printer-recorded data. In one embodiment, memory 16 specifically includes a 26—bit ROM 16A, having 13 "fusible" bits and 13 "masked" bits. In an alternative embodiment, all 26 bits in ROM 16A are fusible bits. With fusible bits, at any point in the product's life, the fusible bits can be blown with the correct equipment. Thus, the use of fusible bits provides a great deal of flexibility. In contrast, masked bits are "hard-coded" bits that are defined during the fabrication process.

Current printer systems typically include one or more replaceable printer components, including inkjet cartridges, inkjet printhead assemblies, and ink supplies. Some existing systems provide the replaceable printer components with on-board memory to communicate information to the printer about the replaceable component. The on-board memory, for an inkjet cartridge for example, typically stores information such as manufacture date (to ensure that excessively old ink does not damage the printhead,) ink color (to prevent misinstallation,) and product identifying codes (to ensure that incompatible or inferior source ink does not enter and damage other printer parts.). Such a memory may also store other information about the ink container, such as ink level information. The ink level information can be transmitted to the printer to indicate the amount of ink remaining. A user can observe the ink level information and anticipate replacing a depleted ink container.

Each fusible bit may be set by blowing a resistor in a circuit 300A (shown in FIG. 3A) representing the fusible bit. Each masked bit may be set by adding a resistor in a circuit 300B (shown in FIG. 3B) representing the masked bit. In one embodiment, ROM 16A is integrated with inkjet printhead assembly 14. In an alternative embodiment, ROM 16A may be integrated with ink supply 26. It will be understood by one of ordinary skill in the art that, rather than incorporating inkjet printhead assembly 14 and ink supply 26 into an inkjet cartridge 12, inkjet printhead assembly 14 and ink supply 26 may be separately housed and may include separate memories.

Printer 10 includes communication lines 20 for communications between inkjet cartridge 12 and controller 34. Communication lines 20 include address lines 20A, first encode enable line 20B, second encode enable line 20C, and output line 20D, which are all connected to ROM 16A in one embodiment. In one form of the invention, address lines 20A include 13 address lines. First encode enable line 20B is used to select fusible bits in ROM 16A, and second encode enable line 20C is used to select masked bits in ROM 16A. Address lines 20A are used to select a particular fusible bit or masked bit. The value of a selected fusible or masked bit is read by sensing the output on output line 20D.

Inkjet printhead assembly 14, memory 16, and ink supply 26 are connected to controller 34, which includes both electronics and firmware for the control of the various printer components or sub-assemblies. A print control procedure 35, which may be incorporated in the printer driver, causes the reading of data from memory 16 and adjusts printer operation in accordance with the data accessed from memory 16. Controller 34 controls inkjet printhead assembly 14 and ink supply 26 to cause ink droplets to be ejected in a controlled fashion on print media 32.

A host processor 36 is connected to controller 34, and includes a central processing unit (CPU) 38 and a software printer driver 40. A monitor 41 is connected to host processor 36, and is used to display various messages that are indicative of the state of inkjet printer 10. Alternatively, printer 10 can be configured for stand-alone or networked operation wherein messages are displayed on a front panel of the printer.

II. Encoding TSR Information

As shown in FIG. 1, inkjet printhead assembly 14 includes TSR 14B. In one embodiment, TSR 14B is 0.5 percent copper, and 99.5 percent aluminum. The resistance of TSR 14B is measured during the fabrication process, and then some bits are "blown" in ROM 16A to store an encoded value representing the measured resistance.

In one embodiment, the resistance of the TSR 14B on each printhead assembly 14 on a wafer is measured at 32 degrees Celsius. In one form of the invention, 280 printhead assemblies 14 are formed on a single wafer. The measured resistance value is truncated (e.g., 258.9 ohms becomes 258 ohms). The truncated resistance value is then found in resistance-to-encode value lookup table 200, shown in FIG. 2.

Lookup table 200 includes columns 202A and 202B, and a plurality of entries 204. Each entry 204 in lookup table 200 associates a set of bit values (shown in column 202B) with a resistance value (shown in column 202A). Based on the bit values found in column 202B for the measured resistance value, corresponding bits are blown in ROM 16A to store the TSR resistance information. The blown bits in ROM 16A are later tested to ensure that the correct encoded TSR resistance values have been stored. In one form of the invention, to protect against error, if none of the TSR bits are blown (i.e., changed from 0 to 1), the part is rejected at the wafer level. If none of the TSR bits are changed, it indicates that the part was somehow skipped during the bit blowing process, or the bit blowing process did not work correctly for the particular part.

III. ROM Circuits

The bit blowing process for ROM 16A varies depending upon whether the bit is a fusible bit or a masked bit. FIG. 3A is a schematic diagram of a circuit for defining the state of a fusible bit in ROM 16A. Circuit 300A includes first encode enable input (E_on) 302, output (id_out) 304, address input 306, transistor 308, resistor 310, transistor 312, second encode enable input (E_off) 314, transistor 316, and ground (p_gnd) 318. Address input 306 is coupled to one of address lines 20A (shown in FIG. 1). First encode enable input 302 is coupled to first encode enable line 20B (shown in FIG. 1). Second encode enable input 314 is coupled to second encode enable line 20C (shown in FIG. 1). Output 304 is coupled to output line 20D (shown in FIG. 1).

In one embodiment, each of transistors 308, 312 and 316 is a field effect transistor (FET). Address input 306 is coupled to the drain of transistor 308. First encode enable input 302 is coupled to the gate of transistor 308. The source of transistor 308 is coupled to the gate of transistor 312 and the drain of transistor 316. The gate of transistor 316 is coupled to second encode enable input 314. The drain of transistor 316 is coupled to the source of transistor 308 and the gate of transistor 312. The source of transistor 316 is coupled to ground 318. Resistor 310 is positioned between output 304 and the drain of transistor 312. The source of transistor 312 is coupled to ground 318.

A fusible bit in ROM 16A, such as the bit represented by circuit 300A, is read by setting first encode enable input 302 high, setting address input 306 high, and sensing the signal at output 304. First encode enable input 302 is set high by controller 34 by setting first encode enable line 20B high. Address input 306 is set high by controller 34 by setting the address line 20A coupled to address input 306 high. The output voltage at output 304 is sensed by controller 34 by sensing the voltage on output line 20D.

Transistor 308 acts as an AND gate, with inputs 302 and 306. If inputs 302 and 306 are both high, a current flows through transistor 308, turning on transistor 312. Transistor 312 acts as a drive transistor, driving output 304. If resistor 310 is blown, the voltage at output 304 will be high, indicating a logical 1. If resistor 310 is not blown, the voltage at output 304 will be low, indicating a logical 0. In one embodiment, resistor 310 is blown by driving a large current through resistor 310. Transistor 316 is used as an active pull down to prevent leakage current from transistor 308 from turning on transistor 312 when transistor 312 should be off. Transistor 316 is turned on by setting second encode enable input 314 high. When turned on, transistor 316 diverts current from transistor 308 to ground.

In addition to blowing resistor 310, other methods may be used to create an open circuit to define the state of a bit in ROM 16A, including mechanical cutting, laser cutting, as well as other methods.

Figure 3B:
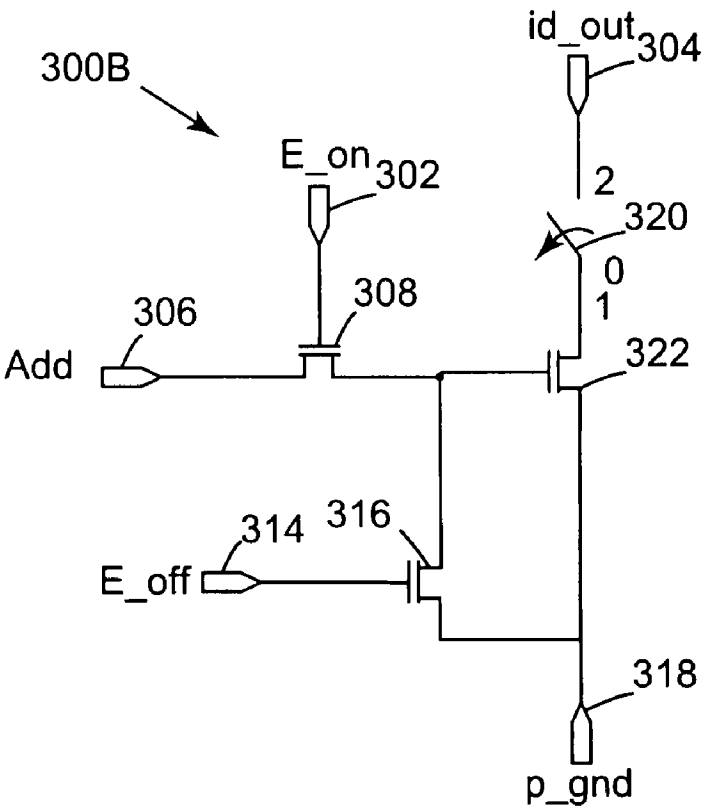
FIG. 3B is a schematic diagram of one embodiment of a circuit for defining the state of a masked bit of an inkjet cartridge memory.
Figure 3A:
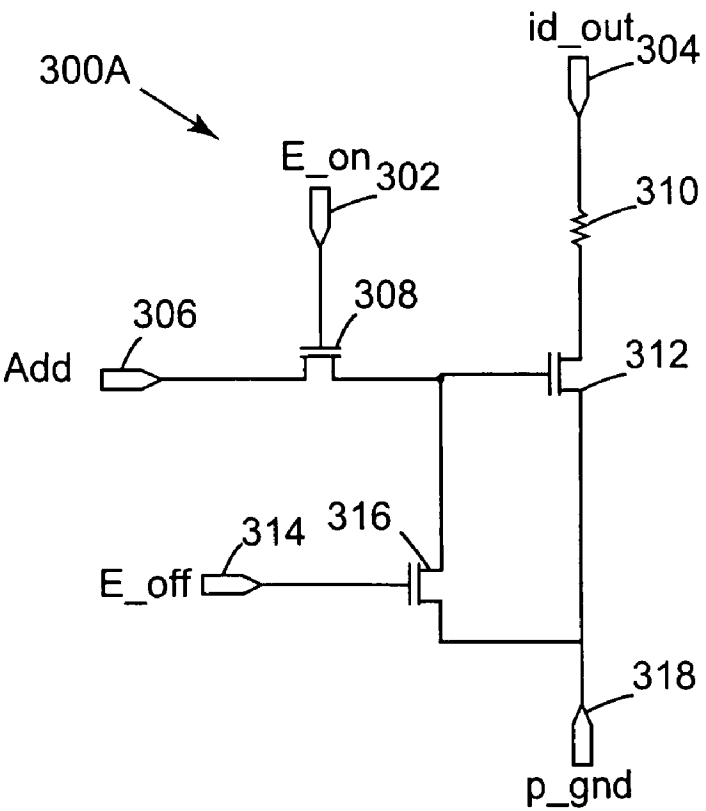
FIG. 3A is a schematic diagram of one embodiment of a circuit for defining the state of a fusible bit of an inkjet cartridge memory.

FIG. 3B is a schematic diagram of a circuit for defining the state of a masked bit in ROM 16A. Circuit 300B is substantially the same as circuit 300A shown in FIG. 3A, with the exceptions that resistor 310 is replaced by switch 320, and transistor 322 has a narrow width than transistor 312. In one embodiment, switch 320 is not an actual physical switch, but represents either the presence or absence of a resistor. In one form of the invention, a resistor 320 is added during the fabrication process to provide a logical 1 bit value. If a resistor is present in place of switch 320, the resistor has sufficient resistance to act as an open circuit between output 304 and transistor 322. If a resistor is not present in place of switch 320, there is no additional resistance between output 304 and transistor 322.

Address input 306 is coupled to one of address lines 20A (shown in FIG. 1). First encode enable input 302 is coupled to second encode enable line 20C (shown in FIG. 1). Second encode enable input 314 is coupled to first encode enable line 20B (shown in FIG. 1). Output 304 is coupled to output line 20D (shown in FIG. 1).

Address input 306 is coupled to the drain of transistor 308. First encode enable input 302 is coupled to the gate of transistor 308. The source of transistor 308 is coupled to the gate of transistor 322 and the drain of transistor 316. The gate of transistor 316 is coupled to second encode enable input 314. The drain of transistor 316 is coupled to the source of transistor 308 and the gate of transistor 322. The source of transistor 316 is coupled to ground 318. Switch 310 is positioned between output 304 and the drain of transistor 322. The source of transistor 322 is coupled to ground 318.

A masked bit in ROM 16A, such as the bit represented by circuit 300B, is read by setting first encode enable input 302 high, setting address input 306 high, and sensing the signal at output 304. First encode enable input 302 is set high by controller 34 by setting second encode enable line 20C high. Address input 306 is set high by controller 34 by setting the address line 20A coupled to address input 306 high. The output voltage at output 304 is sensed by controller 34 by sensing the voltage on output line 20D.

Transistor 308 acts as an AND gate, with inputs 302 and 306. If inputs 302 and 306 are both high, a current flows through transistor 308, turning on transistor 322. Transistor 322 acts as a drive transistor, driving output 304. If switch 310 is open (i.e., resistor present), the voltage at output 304 will be high, indicating a logical 1. If switch 310 is closed (i.e., resistor not present), the voltage at output 304 will be low, indicating a logical 0. Transistor 316 is used as an active pull down to prevent leakage current from transistor 308 from turning on transistor 322 when transistor 322 should be off. Transistor 316 is turned on by setting second encode enable input 314 high. When turned on, transistor 316 diverts current from transistor 308 to ground.

IV. ROM Contents

Figure 4:
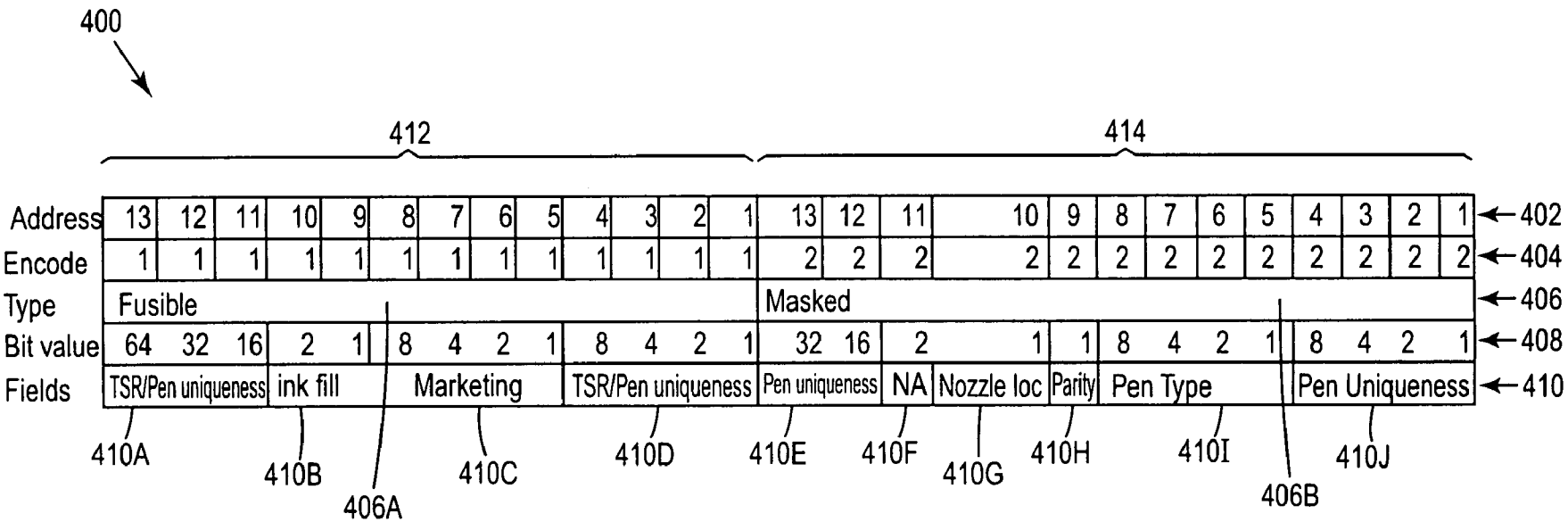
FIG. 4 is a diagram of a table illustrating information stored in an inkjet cartridge memory according to one embodiment of the present invention.

FIG. 4 is a table illustrating information stored in ROM 16A according to one embodiment of the present invention. Table 400 includes address line identifiers 402, encode enable line identifiers 404, bit type identifiers 406A and 406B (collectively referred to as bit type identifiers 406), bit values 408, and fields 410A–410J (collectively referred to as fields 410). Table 400 is divided into portion 412 and portion 414. Portion 412 of table 400 represents information associated with fusible bits, as indicated by fusible type identifier 406A. Portion 414 of table 400 represents information associated with masked bits, as indicated by masked type identifier 406B. Each one of the address line identifiers 402 represents one of address lines 20A (shown in FIG. 1), and corresponds to either a fusible bit or a masked bit. Both the fusible and the masked bits are numbered 1–13, indicating the particular address line 20A associated with the bit. Encode enable line identifiers 404 indicate the encode enable line 20B or 20C that must be set in order to select the corresponding bit. A "1" in encode enable line identifiers 404 corresponds to first encode enable line 20B, which is used to select fusible bits. A "2" in encode enable line identifiers 404 corresponds to second encode enable line 20C, which is used to select masked bits.

Fusible bits 1–13 and masked bits 1–13 are divided into a plurality of fields 410. Each bit in a particular field 410 includes a bit value 408. When a bit is set, it has the value indicated in its corresponding bit value 408. When a bit is not set, it has a value of 0. In one embodiment, fusible bits 1–13 and masked bits 1–13 are set during manufacture of ROM 16A. In an alternative embodiment, fusible bits 1–13 are set post-manufacture of ROM 16A. Also, as mentioned above, ROM 16A includes all fusible bits in an alternative embodiment, so all bits can be set post-manufacture.

TSR/Pen uniqueness field 410A includes fusible bits 11–13. In one embodiment, fusible bits 11–13 are the most significant 3 bits representing the measured resistance of TSR 14B. As mentioned above, the bits representing the measured resistance of TSR 14B are taken from column 202B of lookup table 200. As will be described further below, the TSR bits are also used to provide pen uniqueness information.

Ink fill field 410B includes fusible bits 9–10. In one embodiment, fusible bits 9–10 provide a reference level or trigger level to determine when a low ink warning should be displayed.

Marketing field 410C includes fusible bits 5–8. In one embodiment, fusible bits 5–8 are used to identify whether an inkjet cartridge can be used in a particular printer.

TSR/Pen uniqueness field 410D includes fusible bits 14. In one embodiment, fusible bits 14 are the least significant 4 bits representing the measured resistance of TSR 14B. As mentioned above, the bits representing the measured resistance of TSR 14B are taken from column 202B of lookup table 200. As will be described further below, the TSR bits are also used to provide pen uniqueness information.

Pen uniqueness field 410E includes masked bits 12–13. In one embodiment, masked bits 12–13 are the most significant two bits of a random number that is used in conjunction with TSR/Pen uniqueness fields 410A and 410D to provide a pen uniqueness value for inkjet cartridge 12.

Field 410F includes masked bit 11. In one embodiment, masked bit 11 is not used to store data, so field 410F includes the letters "NA" (i.e., not assigned).

Field 410G includes masked bit 10. In one embodiment, masked bit 10 provides nozzle location information.

Field 410H includes masked bit 9. In one embodiment, masked bit 9 is a parity bit used in association with the bits corresponding to pen type field 4101.

Pen type field 4101 includes masked bits 5–8. In one embodiment, masked bits 5–8 provide an identification of the type of inkjet cartridge that is associated with ROM 16A.

Pen uniqueness field 410J includes masked bits 1–4. In one embodiment, masked bits 1–4 are the least significant 4 bits of a random number that is used in conjunction with TSR/Pen uniqueness fields 410A and 410D to provide a pen uniqueness value for inkjet cartridge 12. The pen uniqueness value, comprising fields 410A, 410D, 410E, and 410J, uniquely identifies an inkjet cartridge 12, which allows printer controller 34 to determine when a new inkjet cartridge has been installed. In one embodiment, if the pen uniqueness value of a newly inserted cartridge is different than the last three cartridges inserted, the printer will behave as if a new cartridge has been inserted, and may perform an alignment scheme, an ink level sense reset and energy calibration.

Printer 10 obtains TSR resistance information from fields 410A and 410D in ROM 16A, and can determine the temperature of inkjet printhead assembly 14. Unlike previous printing systems, printer 10 does not have to perform an initial analog measurement of the resistance of TSR 14B. By knowing the thermal coefficient of resistance (TCR), and the resistance of TSR 14B at a certain temperature (which is encoded in fields 410A and 410D in ROM 16A), printer 10 can determine from other factors the temperature of inkjet printhead assembly 14. Printer 10 can also obtain a pen uniqueness value from ROM 16A, which includes the encoded TSR information in fields 410A and 410D, as well as a random number from fields 410E and 410J.

In prior printer products, the TSRs have been designed to have the same length for every inkjet printhead assembly die on a wafer, and have been designed to have the same nominal resistance of about 240–250 ohms. To provide a greater degree of randomness to the pen uniqueness values, in one embodiment of the present invention, the range of TSR values in fields 410A and 410D is extended by fabricating TSRs 14B with different nominal resistance values, as described in further detail below.

V. Variable TSR

Figure 5A:
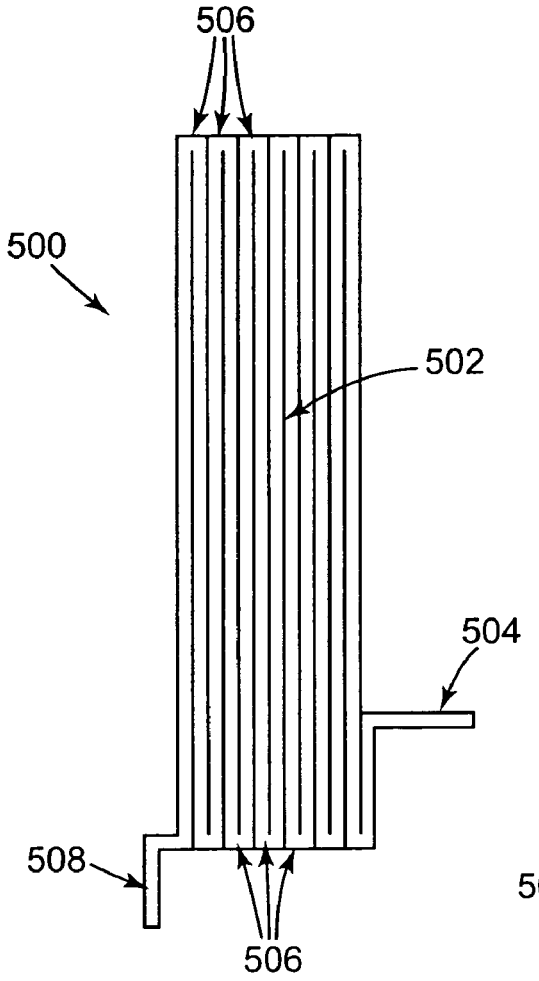
FIG. 5A is an enlarged top view of a variable length portion of a TSR according to one embodiment of the present invention.

FIG. 5A is an enlarged top view of a variable length portion 500 of TSR 14B. In one embodiment, variable length portion 500 is positioned near a lower left corner of the inkjet printhead assembly die. In one form of the invention, TSR 14B also includes other portions coupled to variable portion 500 that extend to other regions of the inkjet printhead assembly die.

Variable TSR portion 500 includes serpentine-shaped region 502 having a plurality of transition regions 506 near the top and the bottom of serpentine region 502. In one embodiment, current enters TSR portion 500 through conductor 508, moves up and down through the multiple legs of serpentine region 502, and then exits through conductor 504.

In one form of the invention, the design for TSR portion 500 is included in the die database for inkjet printhead assembly 14. TSR portion 500 is formed using standard fabrication techniques that include depositing a metal layer, and etching the metal layer using an appropriate photomask to generate the serpentine shape 502 shown in FIG. 5A.

Figure 5B:
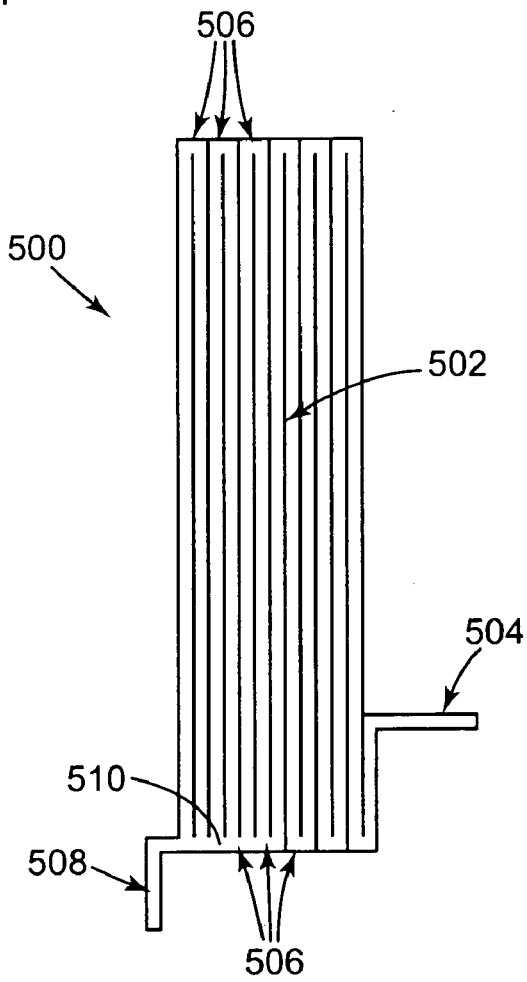
FIG. 5B is an enlarged top view of the variable length TSR portion illustrated in FIG. 5A with a shorting bar added to vary the nominal TSR resistance.

FIG. 5B is an enlarged top view of the variable TSR portion 500 shown in FIG. 5A, with a shorting bar or jumper 510 added to vary the resistance of portion 500, and correspondingly, the resistance of the entire TSR 14B. Shorting bar 510 effectively shortens TSR portion 500 by shorting the first few transition regions 506 near the bottom of TSR portion 500, thereby changing the nominal resistance of TSR 14B. So instead of going up and down through the first few legs of serpentine portion 502, most of the current will flow horizontally through shorting bar 510 until the current reaches about halfway across serpentine portion 502, and then the current will start flowing up and down through the remaining legs of serpentine portion 502 and exit through conductor 504.

In one embodiment, four different lengths of TSR 14B (and four different nominal resistance values) are provided on a wafer by modifying the length of variable TSR portion 500 with a variable length shorting bar 510. In an alternative embodiment, five different lengths of TSR 14B (and five different nominal resistance values) are provided on a wafer. Other numbers of TSR lengths may be provided in additional alternative embodiments.

One form of the present invention provides a method of fabricating variable resistance TSRs in inkjet printhead assemblies, without the need to design a unique inkjet printhead assembly die for each desired TSR nominal resistance value. In one embodiment, variable length shorting bars 510 are added in the mask frame instead of the inkjet printhead assembly die. Thus, mask frame data (rather than die data) is used to make minor modifications to the length of the TSRs 14B on a wafer.

One generic inkjet printhead assembly die design is replicated multiple times on a wafer (or multiple wafers). In one form of the invention, there are 280 inkjet printhead assembly die formed on a wafer. A database contains soft copies of the generic die design. The inkjet printhead assembly die is designed once, and the design is put in 280 times into a full wafer photomask. In addition to die data, the photomask also includes frame data. The frame is generally a border around each individual die. The frame data is stored separately from the die data. The frame is relatively large, has only a few features in it, and has spots for 280 die. The frame is populated with 280 copies of the generic inkjet printhead assembly die contained in the die database. The frame includes features for generating variable length shorting bars 510.

In an alternative embodiment, a photomask with four or five die spots is used. So four or five inkjet printhead assembly die would be printed, the photomask would be moved, four or five more die would be printed, and the process would be repeated until 280 die have been generated. Alternatively, the four or five die in the photomask could be inserted into a larger photomask, such as a full wafer photomask. The four or five die in the photomask would be substantially identical, except that the overlaid frame adds shorting bars 510 of varying length to produce TSRs 14B of varying nominal resistance.

Figure 6:
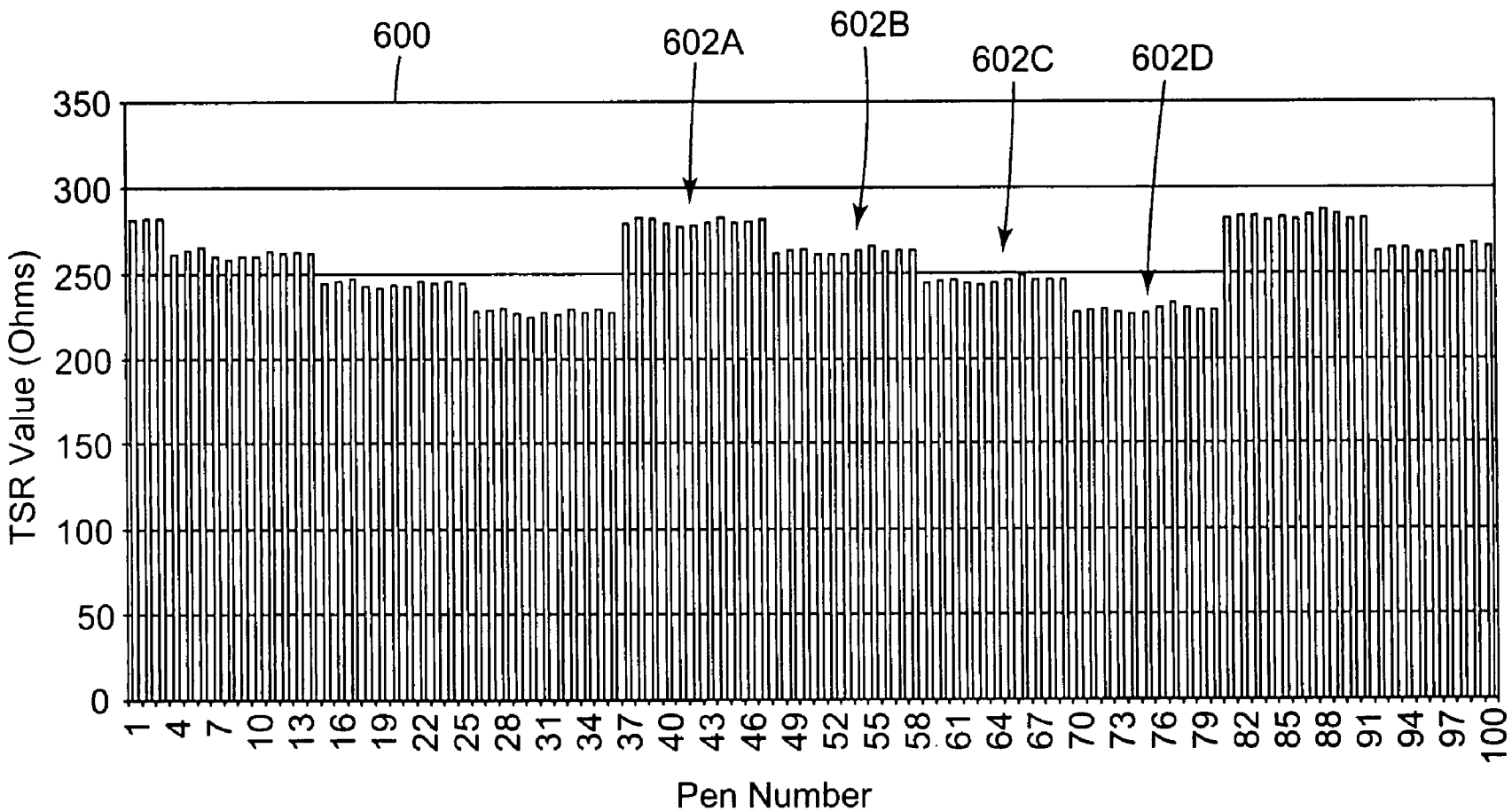
FIG. 6 is a bar graph illustrating one embodiment of the measured TSR resistance from a plurality of inkjet printhead assemblies on a single wafer.

FIG. 6 is a bar graph 600 illustrating the measured TSR resistance from a plurality of inkjet printhead assemblies 14 on a single wafer. On the horizontal axis, there is a list of pen numbers ranging from 1 to 100, each of which represents one inkjet printhead assembly 14 on a single wafer. In one embodiment, there are up to 280 inkjet printhead assemblies on a wafer, but only 100 are shown in FIG. 6. The vertical axis shows resistance values in ohms for TSRs 14B.

As indicated by graph 600, there are four different lengths of TSRs 14B (and four different nominal resistance values) for the inkjet printhead assemblies 14 on the wafer (which are identified by reference numbers 602A, 602B, 602C, and 602D). Despite being designed for the same nominal resistance, the TSR resistance varies within each one of the four groups 602A, 602B, 602C, and 602D, because of manufacturing tolerances. Thus, in addition to the designed four (or five) nominal resistance differences, there is a range of TSR resistance values within each group 602A, 602B, 602C, and 602D of TSRs 14B. The thickness, line width, and material composition of the TSRs 14B may vary across the wafer. So even though the TSRs 14B are designed for a nominal point, there is a certain range of measurements that will occur in the normal manufacture of these parts.

Within each group 602A, 602B, 602C, or 602D of TSRs 14B, if the truncated resistance value of one TSR 14B varies enough from another TSR 14B (e.g., one ohm or more), the two TSRs 14B will be assigned a different set of TSR bits (which are stored in fields 410A and 410D of ROM 16A). If there is not more than one ohm separation between the truncated resistance values of TSRs 14B, the TSRs 14B will have the same set of seven bits in fields 410A and 410D, but the additional bits in fields 410E and 410J will cause a variation in the pen uniqueness value. Graph 600 also indicates that, if the nominal resistance of the TSRs 14B were not variable, the only variation in fields 410A and 410D would be the relatively minor resistance variation that occurs within a single group 602A, 602B, 602C, or 602D. And the likelihood of getting pen uniqueness values that are the same would go up.

One embodiment of the present invention encodes and stores the TSR resistance at a certain temperature in a replaceable printer component, and thereby eliminates the analog measurement hardware and the associated cost. Printer 10 is, therefore, able to use the encoded data along with additional factors to determine the temperature of printhead assembly 14, without performing the previously required initial analog measurement of the TSR resistance.

Embodiments of the present invention also address the problem of the limited number of bits that are typically available in a replaceable printer component memory by double using certain bits, and thereby avoid the additional cost for adding more bits. In one embodiment, bits that represent one type of information (e.g., pen uniqueness information) are also used to represent encoded TSR information. Also, in embodiments of the present invention, the nominal resistance of the TSRs is varied in manufacturing to increase the range of TSR bit values, and thereby provide more randomness or uniqueness for the pen uniqueness values.

Although specific embodiments have been illustrated and described herein for purposes of description of the preferred embodiment, it will be appreciated by those of ordinary skill in the art that a wide variety of alternate and/or equivalent implementations may be substituted for the specific embodiments shown and described without departing from the scope of the present invention. Those with skill in the chemical, mechanical, electro-mechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A method of forming a plurality of replaceable printer components with thermal sense resistors having varying nominal resistance values, the method comprising:

forming the plurality of replaceable printer components on a wafer, the plurality of replaceable printer components each including a thermal sense resistor, each thermal sense resistor having substantially the same nominal resistance; and forming a plurality of resistance modifiers on the wafer, the plurality of resistance modifiers configured to modify the nominal resistance of the plurality of thermal sense resistors, thereby forming thermal sense resistors having varying nominal resistance values.

2. The method of claim 1, and further comprising:

associating each one of a plurality of memories with one of the plurality of replaceable printer components;

measuring the resistance of each of the thermal sense resistors; and storing a resistance value in each of the plurality of memories, the resistance value in each memory representing a magnitude of the measured resistance of the thermal sense resistor associated with the memory.

3. The method of claim 2, wherein each of the plurality of memories is a ROM.

4. The method of claim 2, wherein each of the stored resistance values also represents at least a portion of a second type of component information.

5. The method of claim 4, wherein the second type of component information is component uniqueness information.

6. The method of claim 4, wherein the second type of component information is pen uniqueness information.

7. The method of claim 1, wherein each of the plurality of replaceable printer components is formed based on a single set of generic die data.

8. The method of claim 7, wherein each of the plurality of resistance modifiers is formed based on mask frame data.

9. The method of claim 1, wherein each of the replaceable printer components is an inkjet printhead assembly.

10. The method of claim 1, wherein each of the plurality of resistance modifiers is a conductor far shorting a portion of one of the thermal sense resistors.

11. The method of claim 1, and further comprising:

forming at least a portion of each one of the thermal sense resistors in a serpentine shape having a plurality of transition regions.

12. The method of claim 11, wherein each of the resistance modifiers is a conductor positioned near at least one of the transition regions for shorting a portion of one of the thermal sense resistors.

* * * * *

UNITED STATES PATENT AND TRADEMARK OFFICE

CERTIFICATE OF CORRECTION

PATENT NO. : 7,128,401 B2
APPLICATION NO. : 11/196088
DATED : October 31, 2006
INVENTOR(S) : Simon Dodd It is certified that error appears in the above-identified patent and that said Letters Patent is hereby corrected as shown below:

In column 10, line 45, in Claim 10, delete "far" and insert -- for --, therefor.

Signed and Sealed this

Fourteenth Day of April, 2009

John Doll

JOHN DOLL
*Acting Director of the United States Patent and Trademark Office*